United States Patent [19]

Tschanen

[11] Patent Number: 5,037,002

[45] Date of Patent: Aug. 6, 1991

[54] INTEGRAL SELF-SUPPORTING AND RECYCLABLE LIQUID CONTAINER

[75] Inventor: M. Stephen Tschanen, Columbus, Ohio

[73] Assignee: Liqui-Box/B-Bar-B Corporation, Worthington, Ohio

[21] Appl. No.: 550,874

[22] Filed: Jul. 11, 1990

[51] Int. Cl.[5] ..... B65D 35/00

[52] U.S. Cl. ..... 222/105; 220/424; 220/666; 220/441; 220/461

[58] Field of Search ..... 222/105, 107, 173, 183, 222/92; 220/4.21, 4.24, 666, 465, 461, 462; 229/DIG. 2

[56] References Cited

U.S. PATENT DOCUMENTS

| | | | |
|---|---|---|---|
| 3,067,923 | 12/1962 | Thiets | 220/441 |
| 3,108,732 | 10/1963 | Curie et al. | 222/105 |
| 3,363,807 | 1/1968 | Powell | 222/105 |
| 4,601,410 | 7/1986 | Bond | 222/92 |
| 4,898,301 | 2/1990 | Schick | 220/441 |
| 4,903,859 | 2/1990 | Derby et al. | 220/461 |

FOREIGN PATENT DOCUMENTS

| | | | |
|---|---|---|---|
| 1022538 | 3/1966 | United Kingdom | 220/441 |

*Primary Examiner*—Michael S. Huppert
*Assistant Examiner*—A. Pomrening
*Attorney, Agent, or Firm*—Vorys, Sater, Seymour and Pease

[57] ABSTRACT

An integral self-supporting and recyclable liquid container is disclosed. The container includes an expandable plastic bag and a reinforced assembly which together define an expandable and self-contained liquid chamber from which the contents can be dispensed.

7 Claims, 4 Drawing Sheets

10
2
2
46
48
18
14
18

10
46
46
32
32
14
14
44b
44b
44a
44a
18
18
16
16
32
32
48
46
46

INTEGRAL SELF-SUPPORTING AND RECYCLABLE LIQUID CONTAINER

BACKGROUND OF THE INVENTION

The present invention relates to an improved liquid dispensing container and, more particularly, to an integral, self-supporting and recyclable container.

Bag-like fluid containers generally have a flexible bag-like construction which include a dispensing spout attached to each bag. Such containers are used for dispensing beverages, such as wine, milk, syrup and juices. Known bag-type fluid containers utilize a flexible and liquid expandable plastic bag which progressively collapses during dispensing. One known type of bag has a wall construction comprising a layer of low-density polyethylene (LDPE) and a barrier layer of nylon that are both heat laminated together. Filling and dispensing of the bag's contents occur through the spout. Because of the flexible and inflated nature of the bags when filled, they are not self-supporting and besides are bulky and therefore, difficult to handle. In certain situations, this leads to inconveniences in storing, stacking and handling. For convenience, however, in storing, stacking and shipping these beverage filled containers, the latter are each housed in a corrugated carton or box. The bag spout is arranged to protrude through a carton opening so that the beverage or the like can be dispensed from the bag.

While these bags serve quite successfully, nonetheless, some problems arise. For instance, should the bags experience leakage, there is the possibility that the cardboard cartons housing the bags become wet and, therefore, damaged. A further limitation for the foregoing combination of bag container and cardboard carton concerns recycling. Basically, the foregoing construction does not lend itself to expeditious and inexpensive recycling. Among the reasons are the fact that in order to recycle both the corrugated carton and the plastic bag are required to be pulled apart. This is a relatively time-consuming and, thereby, a costly process.

Moreover, today, there is a growing emphasis on recycling plastic in response to rising concerns about the nation's solid waste disposal problem. Typically, the percentage of plastics recycled is low. This is especially true of plastic packages made of lightweight film, since film is somewhat difficult to collect. Moreover, most collection procedures have to sort through an amalgamation of different types of plastics for recycling. Accordingly, there is a continuing desire to improve the recycling of plastic packages, especially plastic film packages.

SUMMARY OF THE INVENTION

According to the present invention, there is provided a self-supporting liquid dispensing container. Included is a reinforcing body assembly comprising first and second generally superimposed reinforcing panels. Each of the first and second reinforcing panels includes a plurality of integral partitions which are hinged to each other in such a manner that when a fluid is introduced between the superimposed reinforcing panels they self-erect. An inflatable flexible bag is provided which has a pair of sheet assemblies heat sealed around the respective marginal edges thereof to define a respective one of a fluid-tight space for receiving therein respective ones of the first and second reinforcing panels. The sheet assemblies are connected together about the reinforcing panels to also define a progressive fluid chamber which expands during filling and which progressively collapses during dispensing. A dispensing spout is connected through at least one of the panel sections and sheet assemblies so as to allow the filling and dispensing of liquid into and from the liquid compartment.

In an illustrated embodiment, the reinforced body and the flexible bag are made of the same plastic material so as to facilitate recycling thereof.

In another illustrated embodiment, the reinforced body and the bag are both made of low-density polyethylene.

In another illustrated embodiment, the reinforcing body panels are corrugated.

In another illustrated embodiment, the reinforcing body panels have a plurality of longitudinally extending fins formed along one surface thereof which, when the containing compartment is in the erect position, face the interior of the liquid containing compartments and serve to enhance the strength of the fins and the fact that they enhance discharge of syrup.

Among the other objects and features of the present invention are the provision for an improved self-supporting liquid dispensing container; the provisions of an improved self-supporting and recyclable liquid dispensing container; the provision for an improved reinforced bag type container; the provision for an improved self-supporting container including a reinforcing body portion which is self-erectable and self-supporting; the provision for a self-supporting bag container wherein the reinforcing body is corrugated; the provision for a self-supporting bag container wherein the plastic and reinforced body are made of the same material for facilitating ease of recycling; the provision for an improved self-supporting bag container wherein the reinforcing body is protected from liquid; the provision for a self-supporting bag container of the above-noted type wherein the reinforced body member includes a plurality of longitudinally extending fins formed along one interior surface thereof; and, the provision for a self-supporting container having a reinforced portion and which includes an integral handle associated therewith.

Still other objects and further scope of applicability of the present invention will become apparent from the detailed description to follow when taken in conjunction with the accompanying drawings in which like parts are designated by like reference numerals throughout several views.

DETAILED DESCRIPTION

Figure 5:
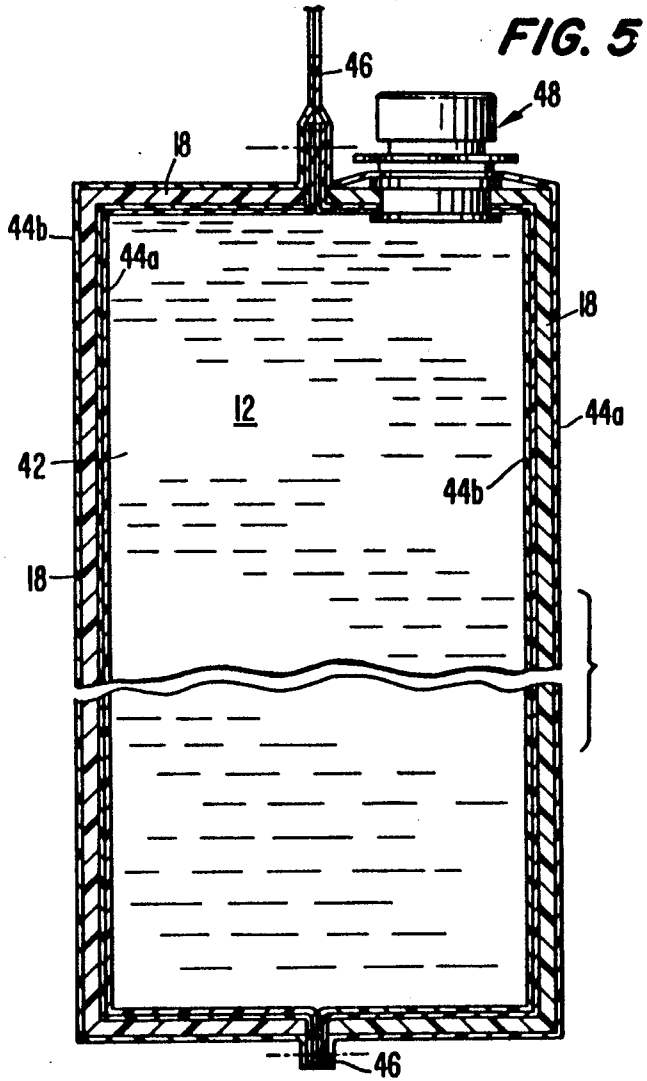
FIG. 5 is a vertical cross-sectional view along section line 5—5 of FIG. 4.
Figure 4:
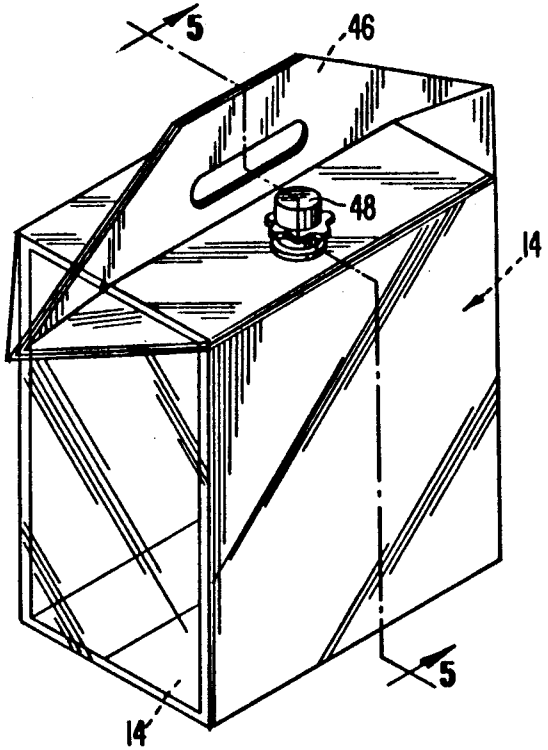
FIG. 4 is a perspective view of the self-supporting container of the present invention illustrated in an erected condition.

Reference is made to FIGS. 1–5 for purposes of illustrating one preferred embodiment of this invention. In connection with FIG. 1, there is shown a self-supporting bag type container 10 in a flattened and collapsed condition prior to the introduction thereinto of a suitable fluid, such as a beverage liquid 12 (see FIG. 5). In particular, the container 10 includes a reinforcing, self-erecting body assembly 14 which is joined in combination with an inflatable plastic diaphragm or bag 16. The self-supporting container 10 is self-erecting to an expanded condition, as shown in FIGS. 4 and 5 upon the introduction of the fluid 12. Significantly, the fluid 12 is stored within the container 10 and in conjunction therewith provides for a self-supporting liquid storage device. The self-supporting characteristics facilitate greatly the handling, stacking and storing thereof. It will be appreciated that the self-supporting container 10 can be made in a variety of sizes and shapes, all of which are capable of storing and dispensing different kinds and quantities of viscous materials.

Reference is now made to the reinforcing body assembly 14. In this embodiment, the reinforcing body assembly 14 is depicted as being comprised of a pair of separate reinforcing panels 18 that are joined together in a manner to be described. Preferably, in this embodiment, each reinforcing panel 18 is made of a flexible and foldable reinforcing blank material. Each reinforcing panel 18 includes a pair of spaced apart plastic sheets 20*a*, 20*b* connected by a plastic corrugated member 22. Other known corrugating or reinforcing constructions are envisioned by this invention for making the flexible and foldable reinforcing panels 18. Each reinforcing panel 18 includes a generally rectangular central partition or portion 24 that will become a container sidewall; a pair of top and bottom generally rectangular foldable panel partitions or portions 26*a*, 26*b* which respectively will become the top and bottom container wall partitions (see FIG. 4) as well as a pair of foldable and rectangular partitions or portions 28*a*, 28*b* which will become end wall members in the filled container (see FIG. 4). Each reinforcing panel can have a suitable thickness for the purposes intended.

According to this invention, the reinforcing panels 18 can have a variety of structural configurations, so long as they can be self-erecting and self-supporting when the liquid or fluid is introduced into the container 10. In this embodiment, the reinforcing panels 18 are made of the same materials as the inflatable bag 16 for reasons which will be mentioned. For facilitating the self-erecting nature of the reinforcing body assembly 14, the panels 18 include hinges 30 in the form of a plurality of V-shaped grooves 32 (see FIGS. 2 and 3) which extend around the marginal edges of the central portion 24 and face inwardly or towards the grooves 32 of the other superimposed reinforcing panel 18. This hinged structure then allows the opposed pair of reinforcing panels 18 to expand from their generally collapsed and parallel condition (see FIG. 1) to their inflated and generally parallelpiped condition (see FIGS. 4 and 5). In this latter condition, of course, the container 10, including the liquid 12, are self-supporting. While a parallelpiped reinforced container is depicted, it will be appreciated that the final configuration of the self-supporting container will assume a configuration which is a function of the geometrical relationships of the partitions that are interconnected to one another. Referring back to the materials of the self-supporting container 10, both the reinforcing body assembly 14 and the bag 16 are, preferably, made of the same low-density polyethylene material. Other materials ca be used for constructing the bag 16 as well as the reinforcing assembly 14; such as high-density polyethylene and (EVOH) ethylene-vinyl alcohol resin. However, it is highly desireable to use the same plastic materials for both the reinforcing body assembly 14 and the bag 16 so as to facilitate recycling.

The inflatable bag I6 is adapted to encase the reinforcing body assembly 14 in a fluid-tight fashion as well as to permit the self-supporting container 10 to progressively inflate during filling thereof and progressively collapse during dispensing thereof. The flexible bag 16 includes a pair of sheet assemblies 40*a*, 40*b* which are sealingly joined along their marginal edges (see FIGS. 2 and 5) as by heat sealing to form a water tight compartment 42 for containing the fluid 12. Each sheet assembly 40*a*, 40*b* is arranged so as to define spaced pairs of inner and outer casings 44*a*, 44*b*; respectively. Each inner casing 44*a* is defined by a pair of superimposed transparent thin film sheets 46 preferably made of low-density polyethylene. The outer casing 44*b* is defined by a similar superimposed transparent low-density polyethylene sheet. The thin-film sheets 46 can be made of a variety of the plastic materials noted above having thicknesses which range up to, preferably, 0.025 inch. Although it is preferred to have the thin-film sheets of identical material for recycling ease, such need not be the case.

It is best seen that each reinforcing panel 18 is encased in a space between respective ones of the inner and outer casings 44*a*, 44*b* thereby making the panels 18 waterproof. Although the pairs of inner and outer casings 44*a*, 44*b* are not depicted as being directly adhered to the reinforcing panels 18, the present invention contemplates that the inner and outer casings can have their casing sheets connected to the reinforcing body in a variety of ways.

Figure 1:
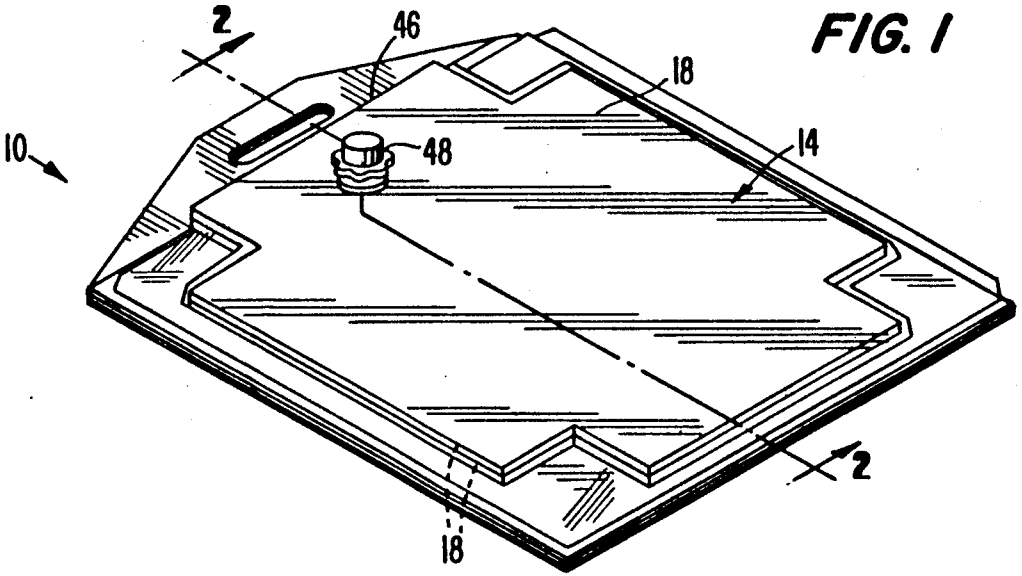
FIG. 1 is a perspective view of a self-supporting bag container made in accordance with the principles of the present invention illustrated in a flat or a non-inflated condition.

Moreover, as shown in FIG. 1, the inner and outer casings 44*a*, 44*b* have a handle portion 47 which allows the bag casings-in-box container 10 to be manually gripped. While each of the inner casing 44*a* has a double ply of the thin-film sheets 46 and the outer casing 44*b* has a single ply of the thin-film sheets 46, the number of plys for each of the inner and outer casings can, of course, vary. It should be appreciated that the double ply arrangement facilitates the prevention of leakage in the event one ply should be ruptured.

Figure 2:
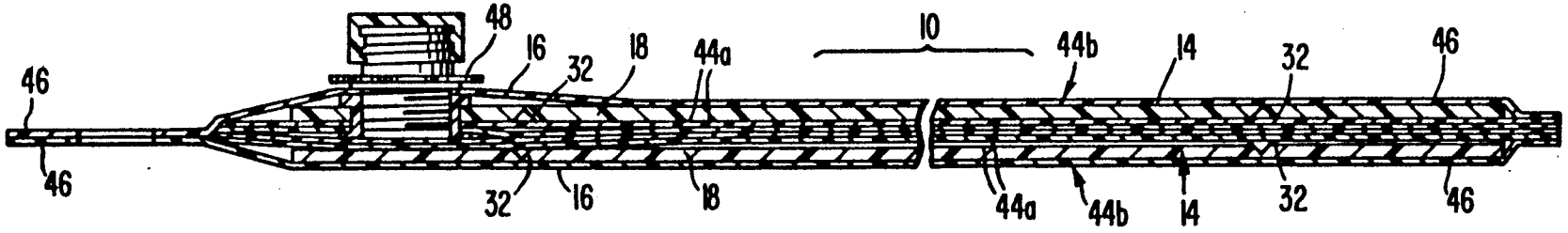
FIG. 2 is longitudinal cross-sectional view taken along section line 2—2 of FIG. 1.
Figure 3:
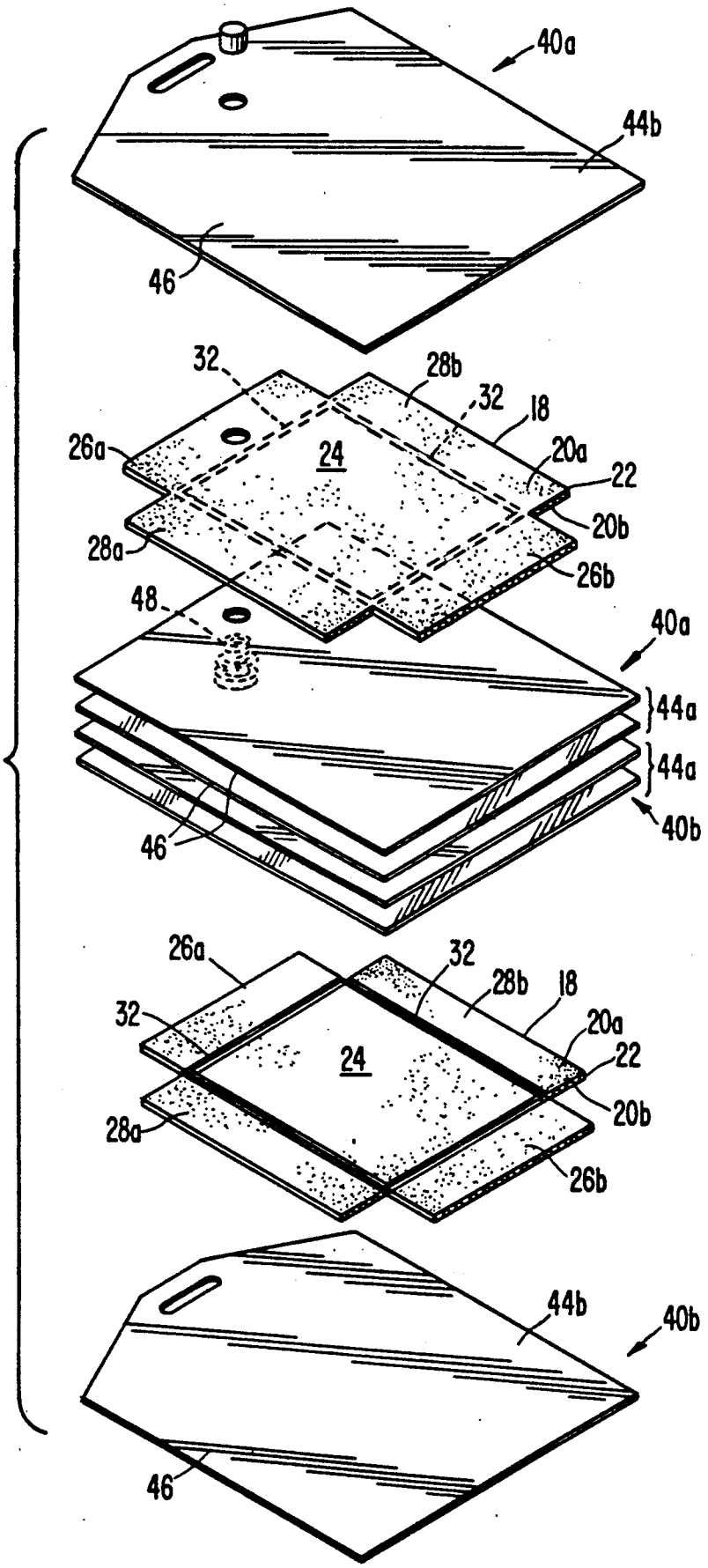
FIG. 3 is an exploded perspective view of one preferred embodiment of the present invention.

Reference is now made to FIG. 2 for illustrating the construction of the dispensing spout 48. Details of the spout are not being disclosed as they do not, per se, form an aspect of the present invention and besides are well-known in the art. Thus, it will be understood that a wide variety of dispensing spouts for use in conjunction with the self-supporting container 10 can be utilized. For a brief understanding however, the spout 48 includes an annular collar connected to an opening in a top portion 26*a*. The spout 48 extends through both inner and outer casings 44*a*, 44*b* and thus fluidly couples the fluid compartment 42 to ambient. The spout 48 is also made of a low-density polyethylene material, but need not be.

Figure 6:
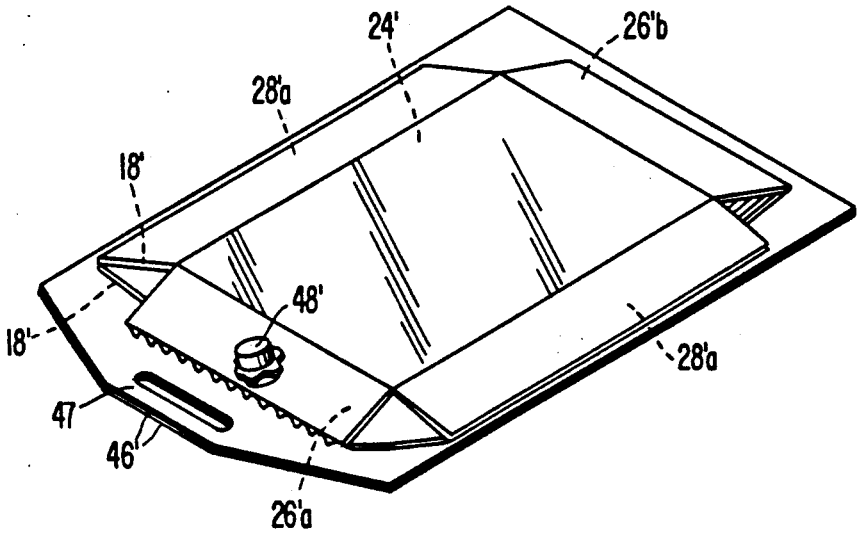
FIG. 6 is a perspective view of a second preferred embodiment of the present invention in a flattened condition.
Figure 7:
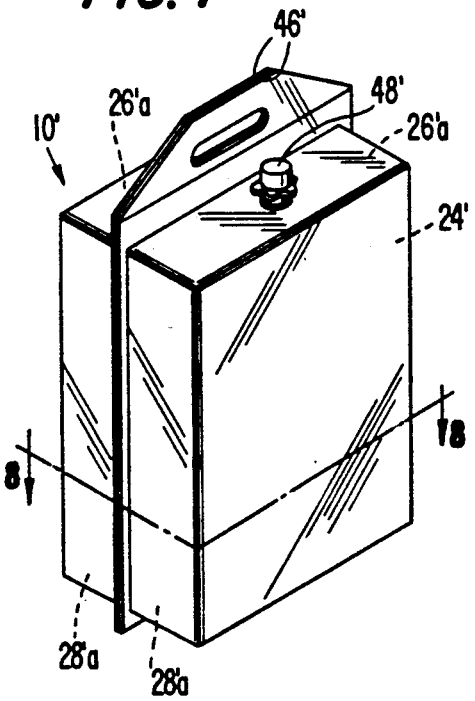
FIG. 7 is a perspective view of the second preferred embodiment in an erected position.
Figure 8:
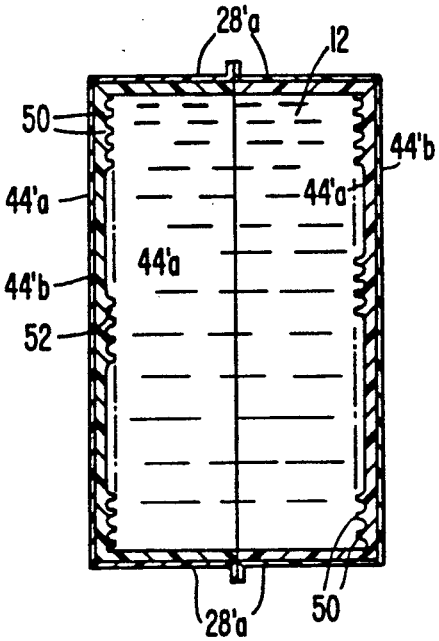
FIG. 8 is horizontal cross-sectional view taken along section line 8—8 of FIG. 7 illustrating other components of the second preferred embodiment.

Reference is now made to FIGS. 6–8 for illustrating another preferred embodiment of the present invention. In this embodiment, like structure of the previous embodiment will be designated by like reference numerals with the addition of a prime number. A significant difference of this embodiment is that each reinforcing panel 18' is not corrugated, but rather is formed with generally parallel fins 50 extending along an interior surface 52 of the reinforcing panel. Each reinforcing panel 18' has the same general configuration of partitions and hinges so that it functions to expand to the position shown in FIGS. 7 and 8 from the generally collapsed condition, (see FIG. 6). The fins 50 serve a dual purpose as they add rigidity to the reinforcing panel 18' as well as allow drainage of the liquid 12 during dispensing. In this latter regard, it will be appreciated that the fins 50 define channels therebetween for drainage during bag collapse. In this manner, all the bag's contents can be dispensed. The panel 18' including the fins can have a height or thickness of about, preferably, up to 0.025 inch or more.

According to the present invention, it will be recognized that certain changes may be made in the above described containers without departing from the scope of the present invention herein involved. It is maintained that all matter contained in this description shall be interpreted as illustrative and not in a limiting sense.

What is claimed is:

1. A self-supporting liquid dispensing container comprising:

a reinforcing body assembly including first and second generally superimposed reinforcing panels; each of said first and second reinforcing panels including a plurality of integral partitions which are hinged to each other in such a manner that when a fluid is introduced between said superimposed reinforcing panels, said first and second reinforcing panels self-erect to form a liquid reinforcing structure for containing fluid;

an inflatable flexible bag having first and second sheet assembly joined together around the marginal edges thereof to define a sealed liquid containing compartment, each of said first and second sheet assemblies including at least a pair of separate flexible walls sealed about their marginal edges and defining a fluid-tight space for receiving therein a respective one of said first and second reinforcing panels; and a spout connected through at least one of said panels and sheet assemblies so as to allow the filling and dispensing of liquid into and from said liquid containing compartment.

2. The self-supporting container of claim 1 wherein said reinforcing body assembly and said flexible bag are made of the same plastic material for purposes of enhancing recycling thereof.

3. The self-supporting container of claim 2 wherein said same material is low-density polyethylene.

4. The self-supporting container of claim 1 wherein each of said reinforcing panels are comprised of a corrugated carton.

5. The self-supporting container of claim 1 wherein each of said reinforcing panels includes a plurality of partitions integrally connected by V-shaped grooves which serve as hinges.

6. The self-supporting container of claim 1 wherein each of said reinforcing panels includes a plurality of fins extending along an interior surface thereof so as to facilitate the dispensing of the bag's contents from a progressively collapsing bag.

7. The self-supporting container of claim 1 wherein said first and second pairs of separate flexible walls comprise a plurality of plastic layers heat sealed around their marginal edges to define said compartment and said space.

* * * * *